United States Patent [19]

Campbell et al.

[11] 4,264,458

[45] Apr. 28, 1981

[54] METALWORKING LUBRICANT COMPOSITION

[75] Inventors: Ian D. Campbell, Sarnia; James H. Norton, Crounna, both of Canada

[73] Assignee: Exxon Research & Engineering Co., Florham Park, N.J.

[21] Appl. No.: 25,752

[22] Filed: Apr. 2, 1979

[51] Int. Cl.[3] ..... C10M 1/48

[52] U.S. Cl. ..... 252/32.7 E; 252/45; 252/46.6

[58] Field of Search ..... 208/19; 252/32.7 E, 252/45, 46.6

[56] References Cited

U.S. PATENT DOCUMENTS

| | | | |
|---|---|---|---|
| 2,168,258 | 8/1939 | Fisher | 208/19 |
| 3,240,696 | 3/1966 | Halik et al. | 208/19 X |
| 3,318,808 | 5/1967 | Plemich et al. | 252/32.7 E |
| 3,775,322 | 11/1973 | Hotten | 252/46.6 |
| 3,984,599 | 10/1976 | Norton | 252/32.7 E X |
| 4,118,331 | 10/1978 | Jahnke | 252/32.7 E |

*Primary Examiner*—Thomas A. Waltz

*Attorney, Agent, or Firm*—Eugene Zagarella, Jr.

[57] ABSTRACT

A metalworking lubricant composition which is particularly effective in high-temperature forging operations comprising a major amount of a naphthenic base oil which includes at least about 20 weight % of reduced naphthenic crude oil and preferably a minor amount of an additive which is either a zinc dihydrocarbyl dithiophosphate or a selected sulfur containing compound.

12 Claims, No Drawings

METALWORKING LUBRICANT COMPOSITION

BACKGROUND OF THE INVENTION

This invention relates to a metalworking lubricant composition which is particularly effective in high-temperature, high-pressure operations and provides satisfactory metal wetting properties while preventing metal sticking and reducing metal wear.

It is well known to use lubricants in metalworking operations such as forging, drawing, rolling, cutting, etc. A variety of base oils and additives has been provided to satisfy the different conditions of such metalworking operations as exemplified in U.S. Pat. No. 3,984,599, issued Oct. 5, 1976 to James H. Norton, and U.S. Pat. No. 4,118,331, issued Oct. 3, 1978 to Richard W. Jahnke.

In high-temperature, high-load operations such as forging, the metalworking lubricant must perform a number of functions including lubrication of the die or metal tool and the workpiece, and particularly must prevent metal sticking or adhesion and help in reducing wear. One characteristic of such a lubricant which is of extreme significance in satisfying such conditions, is its metal wetting ability.

SUMMARY OF THE INVENTION

It has now been found that a metalworking lubricant composition which is particularly effective in high-temperature, high-load operations such as forging, is provided by a composition which comprises a major amount of a naphthenic base oil which includes at least about 20 weight %, based on the weight of the base oil, of reduced naphthenic crude oil, said base oil containing from about 10 to about 60 weight % of asphalt and less than 2 weight % of wax based on the weight of the base oil, said composition having a viscosity of from about 100 to about 500 SUS at 210° F. (99° C.). Particularly preferred compositions of this type will contain a minor amount of an additive which is a zinc dihydrocarbyl dithiophosphate and/or a selected sulfur containing compound. Such sulfur containing compounds include low molecular weight polysulfides and the sulfurized and phosphosulfurized products derived from fatty acid esters of monohydric and polyhydric compounds, olefins and polymeric olefins. Lubricants with such a composition have displayed significantly improved results in metalworking operations including better metal wetting, less metal adhesion and increased wear.

DETAILS OF THE INVENTION

The metalworking lubricant composition of this invention contains a major amount of a naphthenic basic oil which includes selected amounts of reduced naphthenic crude oil.

The base oil used in this invention is a mineral oil basestock referred to as a naphthenic base oil and is the refined product that results after the naphthenic crude oil is subject to one or more of the conventional lubricant processing steps, i.e. crude distillation or topping at near atmospheric pressure, vacuum distillation, extraction, hydrofining, dewaxing and deasphalting. The naphthenic base oil of the invention is comprised largely of cyclic compounds, i.e. naphthenes or cycloparaffins and aromatic hydrocarbons and minor amounts of paraffin hydrocarbons. Thus, use of the term "naphthenic base oil" throughout this application is intended to include minor amounts of paraffin compounds and other components which are difficult to separate and may remain along with the cycloparaffins and aromatics. Naphthenic base oils of this invention include low cold test (LCT) crudes such as Coastal, Venezuela and Tia Juana.

An essential feature of this invention is that the naphthenic base oil contains a specified amount of reduced naphthenic crude oil. The term "reduced naphthenic crude oil" or "reduced crude" as used throughout this application is defined as the bottoms from the atmospheric distillation tower through which the naphthenic crude oil is first passed. In other words, the starting naphthenic crude oil is first subjected to a distillation at near atmospheric pressure known as topping or crude distillation and the bottoms from the distillation tower of this operation is used as the "reduced crude" or "reduced naphthenic crude oil" for this invention.

Generally at least about 20 weight %, preferably at least about 30 and more preferably at least about 50 weight % of reduced crude is used based on the weight of the base oil. The metalworking lubricant composition will contain a significant amount of asphalt, i.e. from about 10 to about 60 weight % and preferably from about 30 to about 60 weight % based on the weight of the base oil. Additionally, the lubricant composition will generally contain from about 0.5 to about 10% and preferably about 1.5 to about 3% by weight of sulfur based on the weight of the base oil. The composition will contain a low amount of wax, generally less than about 2 weight % and preferably less than about 1 weight % based on the weight of the base oil and will have a viscosity of from about 100 to about 500 SUS at 210° F. (99° C.) and preferably from about 300 to about 350 SUS.

The metalworking lubricant composition of this invention will preferably contain a minor amount of an additive which is a zinc dihydrocarbyl dithiophosphate and/or a selected sulfur containing compound. The zinc dihydrocarbyl dithiophosphates useful in the present invention are salts of dihydrocarbyl esters of dithiophosphoric acids and may be represented by the following formula:

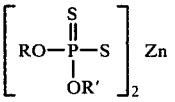

wherein R and R′ may be the same or different hydrocarbyl radicals containing from 1 to 18 and preferably 2 to 12 carbon atoms and including radicals such as alkyl, alkenyl, aryl, aralkyl, alkaryl and cycloaliphatic radicals. Particularly preferred as R and R′ groups are alkyl groups of 2 to 8 carbon atoms. Thus the radicals may, for example, be ethyl, n-propyl, i-propyl, n-butyl, 1-butyl, sec-butyl, tert-butyl, amyl, n-hexyl, i-hexyl, n-heptyl, n-octyl, decyl, dodecyl, octadecyl, 2-ethylhexyl, phenyl butylphenyl, cyclohexyl, methylcyclopentyl, propenyl, butenyl, etc. In order to obtain oil solubility, the total number of carbon atoms in the dithiophosphoric acid will average about 5 or greater.

The zinc dihydrocarbyl dithiophosphates used in the compositions of this invention may be prepared in accordance with known techniques by first esterifying a dithiophosphoric acid usually by reaction of an alcohol or phenol with $P_2S_5$ and then neutralizing the dithiophosphoric acid ester with a suitable zinc compound such as zinc oxide. In general, the alcohol or mixtures of alcohols containing from 1 to 18 carbon atoms may be used to effect the esterification, the hydrocarbon portion of the alcohol may, for example, be a straight- or branched-chain alkyl or alkenyl group, or a cycloaliphatic or aromatic group. Among the alcohols which are generally preferred for use as starting materials in the preparation of the esters may be mentioned ethyl, isopropyl, amyl, 2-ethylhexyl, lauryl, stearyl, and methyl cyclohexyl alcohols as well as commercial mixtures of alcohols, such as the mixture of alcohols derived from coconut oil and known as "Lorol B" alcohol, which mixture consists essentially of alcohols in the $C_{10}$ to $C_{18}$ range. Other natural products containing alcohols such as the alcohols derived from wool fat, natural waxes and the like may be used. Moreover, alcohols produced by the oxidation of petroleum hydrocarbon products as well as the oxo-alcohols produced from olefins, carbon monoxide and hydrogen may be employed. Further aromatic compounds such as alkylated phenols of the type of n-butyl phenol, tertiary amyl phenol, diamyl phenol, tertiary octyl phenol, petroleum phenol and the like, as well as the corresponding naphthols, may be employed in like manner.

Following the esterification, the diester is then neutralized with a suitable basic zinc compound or a mixture of such compounds. In general, any compound could be used, but oxides, hydroxides and carbonates are most generally employed.

The selected sulfur containing compounds which are useful as additives in this composition include low molecular weight polysulfides and the sulfurized and phosphosulfurized products derived from fatty acid esters of monohydric and polyhydric compounds, olefins and polymeric olefins. Illustrative compounds of this type include sulfurized and phosphosulfurized fatty acid ester oils of mono- and polyhydric compounds such as sulfurized sperm oil, sulfurized lard oil, phosphosulfurized sperm oil, phosphosulfurized lard oil, sulfurized and phosphosulfurized tall oil, and blends of various sulfurized and phosphosulfurized animal and vegetable fats, low molecular weight polysulfides such as dibenzyl disulfide or dilauryl trisulfide, sulfurized and phosphosulfurized olefins and polymeric olefins such as sulfurized cracked wax olefins, single olefins (e.g. octadecene-1), sulfurized terpenic olefins having 10 to 32 carbons including those further sulfurized by treatment with sodium sulfide, sulfurized polyisobutylene, phosphosulfurized polyisobutylene, sulfurized isobutylene derivatives and phosphosulfurized polyisobutylene treated with sulfur chloride. These and other compounds of this type may be utilized alone and in combination as well as in combination with the zinc dihydrocarbyl dithiophosphates described above.

Sulfurization of the above-noted oils, olefins and polyolefins is usually carried out by simply heating the olefin with free sulfur to about 180° to 250° C. The sulfur combines with the hydrocarbon portion of the molecule quite readily with an evolution of hydrogen sulfide. The reaction product may be blown to eliminate hydrogen sulfide, washed and low boiling constituents may be evaporated or distilled off with steam. In many cases a small amount of free sulfur is present, not having reacted, and this may be separated by filtration. The sulfur may be either active or inactive as measured by tests for extreme pressure and corrosivity as its state is immaterial for the purpose of the present invention.

Generally, the zinc dihydrocarbyl dithiophosphate and/or selected sulfur containing compound will be present in amounts of from about 0.01 to about 8 weight %, preferably from about 0.1 to about 5, more preferably from about 0.5 to about 3.0 and still more preferably from about 0.5 to about 1.5 weight % based on the total weight of the composition.

A variety of other lubricating additives may be added to the metalworking lubricant composition of the present invention. Such additives include corrosion inhibitors, antioxidants and others generally in use, as for example disclosed in "Lubricant Additives" by C. V. Smalheer and R. Kennedy Smith, 1967 and in Kirk-Othmer, "Encyclopedia of Chemical Technology", 2nd Edition, Vol. 5, pp 574–576. A variety of lubricants or lubricity agents is particularly useful in metalworking lubricant compositions used in forging, including for example, graphite, molybdenum disulfide, talc and mica.

The following examples are set forth to illustrate the invention and should not be construed as limitations thereof.

EXAMPLE 1

A lubricant composition was prepared using a base oil comprising about 32.9 wt. % of a naphthenic low cold test (LCT) oil and 67.1 wt.% of a reduced LCT crude, obtained from the bottoms of the atmospheric distillation tower through which the naphthenic crude oil was passed.

The base oil was formulated into a metalworking lubricant for use as a forging compound by adding 26.7 wt.% powdered graphite, 11.8 wt.% powdered talc and 0.8 wt.% of soap. The base oil contained less than 1% by weight of wax, had about 30% by weight of asphalt and a viscosity of 140 SUS at 210° F.

A sample of this metalworking composition was subjected to a standard high-temperature forging operation and a performance test which includes visual observation of characteristics which included valves sticking and wetting ability, i.e. dryness and adequate surface coating. Based on a visual rating scale of −1 to 10, (higher rating being better) this composition was given a rating of 6.

An additive comprising 1.0 wt.% of zinc dialkyl dithiophosphate, in which the alkyl groups were a mixture of such groups having between about 4 and 5 carbon atoms and made by reacting $P_2S_5$ with a mixture of about 65% isopropyl alcohol and 35% amyl alcohol, was added to the above-defined lubricant composition. This composition was subjected to the same forging operation and performance test and received a rating of 10. The same composition was found to have a die life at 800° F. of 8000 valves/die.

An additive comprising 3.0 wt.% of Emery 9844A, i.e. a sulfurized blend of animal and vegetable fats was added to the first above-defined lubricant composition. This composition was subjected to the same forging operation and performance test and received a rating of 9.

EXAMPLE 2

For comparison purposes, a lubricant composition having a base oil comprising 32.8% by weight of a Coastal naphthenic oil having a viscosity of 85 SUS at 210° F., i.e. 99° C., 50.0 wt.% of a black oil having a viscosity of 210 SUS at 210° F., i.e. 99° C. and 17.2 wt.% of bright stock was prepared having the same graphite, talc and soap additives as described above in Example 1.

This composition was subjected to the same forging operation and performance test as described above in Example 1 and receiving a rating of −1. This composition was found to have a die life at 800° F. of 250 valves/die.

An additive comprising 3.0 wt.% of Emery 9844A, i.e. a sulfurized blend of animal and vegetable fats, was added to the composition which was then subjected to the same forging operation and performance test and received a rating of 0.

EXAMPLE 3

For comparison purposes, a lubricant composition having a base oil comprising 46.6 wt.% of Coastal Oil as in Example 2, 27.7% wt. % of reduced LCT crude and 25.8 wt.% solvent bright stock was prepared having the same graphite, talc and soap additives as described above in Example 1.

This composition was subjected to the same forging operation and performance test as described in Example 1 and received a rating of 3 to 4.

An additive comprising 3.0 wt.% of Emery 9844A was added to the composition which was then subjected to the same forging operation and performance test and received a rating of 8.

From the above results, it is evident that a lubricant composition having a base oil comprising a naphthenic oil in combination with a reduced naphthenic crude oil, as defined by this invention, has particularly improved wettability, less metal adhesion and surprisingly increased wear when used in combination with a zinc hydrocarbyl dithiophosphate or sulfur containing additive compound.

What is claimed is:

1. A metalworking lubricant composition which comprises a major amount of naphthenic base oil which includes at least about 20 weight % of reduced naphthenic crude oil, based on the weight of the base oil and a minor amount of an additive selected from the group consisting of zinc dihydrocarbyl dithiophosphate, low molecular weight polysulfides, sulfurized and phosphosulfurized products derived from fatty acid esters of monohydric compounds, fatty acid esters of polyhydric compounds, olefins and polymeric olefins, said composition containing from about 10 to about 60 weight % of asphalt and less than about 2 weight % of wax based on the weight of the base oil and having a viscosity of about 100 to about 500 SUS at 210° F.

2. The composition of claim 1 which contains from about 0.01 to about 8% by weight of said additive component based on the total weight of the composition.

3. The composition of claim 2 wherein from about 0.1 to about 5% by weight of said additive is used, said additive being zinc dihydrocarbyl dithiophosphate.

4. The composition of claim 3 wherein the dihydrocarbyl groups of said zinc compound are alkyl groups of 2 to 8 carbon atoms.

5. The composition of claim 1 wherein said base oil includes at least about 30 weight % of said reduced naphthenic crude oil based on the weight of the base oil.

6. The composition of claim 5 which contains from about 0.01 to about 8% by weight of said additive component based on the total weight of the composition.

7. The composition of claim 6 wherein from about 0.1 to about 5% by weight of said additive is used, said additive being zinc dihydrocarbyl dithiophosphate.

8. The composition of claim 7 which contains from about 0.5 to about 3% by weight of said dithiophosphate component based on the total weight of the composition and wherein the dihydrocarbyl groups of said dithiophosphate component are alkyl groups of 2 to 8 carbon atoms.

9. The composition of claim 8 wherein said base oil includes at least about 50 weight % of said reduced naphthenic crude oil based on the weight of the base oil.

10. The composition of claim 8 which has a viscosity of 300 to 350 SUS at 210° F.

11. The composition of claim 10 which has from about 30 to about 60 weight % of asphalt and less than about 1 weight % of wax based on the weight of the base oil.

12. The composition of claim 9 which has from about 30 to about 60 weight % of asphalt and less than about 1 weight % of wax based on the weight of the base oil, said composition having a viscosity of 300 to 350 SUS at 210° F.

* * * * *